US007832127B2

(12) United States Patent
Hill

(10) Patent No.: US 7,832,127 B2
(45) Date of Patent: Nov. 16, 2010

(54) APPARATUS FOR ATTACHING A WORK TOOL TO A LOADER

(75) Inventor: Charles E Hill, Karnack, TX (US)

(73) Assignee: Charles E. Hill & Associates, Inc., Jefferson, TX (US)

( * ) Notice: Subject to any disclaimer, the term of this patent is extended or adjusted under 35 U.S.C. 154(b) by 563 days.

(21) Appl. No.: 11/977,796

(22) Filed: Oct. 26, 2007

(65) Prior Publication Data

US 2009/0107016 A1 Apr. 30, 2009

(51) Int. Cl.
*E02F 3/65* (2006.01)

(52) U.S. Cl. ..... 37/417

(58) Field of Classification Search ..... 37/231–236, 37/403–410, 466, 468, 411–424; 172/271–273, 172/466, 481; 414/680, 694, 686, 723, 685
See application file for complete search history.

(56) References Cited

U.S. PATENT DOCUMENTS

| | | | | |
|---|---|---|---|---|
| 4,117,944 | A | 10/1978 | Beckstrom et al. | |
| 4,279,566 | A | 7/1981 | Sagaser | |
| 5,098,252 | A * | 3/1992 | Sheesley et al. | 414/723 |
| 5,171,124 | A | 12/1992 | Foster | |
| 5,403,144 | A * | 4/1995 | Staben, Jr. | 414/697 |
| 5,819,445 | A | 10/1998 | LaBelle et al. | |
| 6,108,907 | A | 8/2000 | Anderson et al. | |
| 6,119,377 | A | 9/2000 | Rubio | |
| 6,637,136 | B2 | 10/2003 | Aoki et al. | |
| 6,769,860 | B2 | 8/2004 | Yoshii et al. | |
| 7,010,874 | B2 | 3/2006 | Uchijima et al. | |
| 7,043,858 | B2 | 5/2006 | Martinez | |
| 7,056,079 | B2 * | 6/2006 | Branham et al. | 414/680 |
| 7,153,084 | B2 * | 12/2006 | Horst et al. | 414/680 |
| 7,156,200 | B2 | 1/2007 | Dershem et al. | |
| 7,188,915 | B2 | 3/2007 | Lemke et al. | |
| 7,618,229 | B2 * | 11/2009 | Boling et al. | 414/685 |
| 7,648,326 | B2 * | 1/2010 | Santele et al. | 414/723 |
| 2006/0005436 | A1 | 1/2006 | Martinez | |

OTHER PUBLICATIONS

Five (5) Photographs of Prior Art Device.

* cited by examiner

*Primary Examiner*—Robert E Pezzuto
(74) *Attorney, Agent, or Firm*—Baker & Daniels LLP

(57) ABSTRACT

A restraint apparatus limits pivotal movement of an attachment receiver which is pivotably coupled to movable first and second arms of a loader. The attachment receiver is configured to be coupled to a mounting frame of a work tool. The restraint apparatus includes an attachment member configured to be coupled to one of the first and second arms of the loader, a side plate coupled to the attachment member, and a blocking member coupled to the side plate. The blocking member is configured to engage the mounting frame of the work tool to block pivotal movement of the attachment receiver and the mounting frame relative to the first and second arms.

20 Claims, 3 Drawing Sheets

APPARATUS FOR ATTACHING A WORK TOOL TO A LOADER

BACKGROUND AND SUMMARY OF THE INVENTION

The present invention relates generally to excavation equipment. More particularly, the present invention relates to an improved method and apparatus for attaching a work tool, such as a backhoe attachment, to a loader such as a front-end loader or skid loader.

A loader, also called a front-end loader, is a type of tractor that typically uses a wide square tilting bucket located on the end of movable arms to lift and move material. There are many varieties of front-end loaders, including small loaders referred to as "skid loaders". The model RC-100 track loader available from ASV, Inc. is one illustrated example of a skid loader. The Bobcat Company also makes several models of skid loaders. The loader has arms which are adapted to position the bucket vertically and to tilt or rotate the bucket about a rotational axis.

Skid loaders are commonly used for clearing construction sites or moving materials on such sites. The bucket assembly may be removably attached or permanently mounted to the loader. Numerous attachments have been developed for skid loaders in order to perform various tasks in addition to front-end loading tasks. Often the bucket may be replaced with other devices or work tools. For example, dozer blades, snow blades, extendible backhoes, forestry packages, brush mulchers, hydraulic augers, brush cutters, trenchers and snow blower attachments can be coupled to the loader.

For maximum flexibility of use, the loaders typically include an attachment receiver coupled to arms of the loader. Work tools are typically coupled to an mounting frame. The attachment receiver is configured to be attached to the mounting frame of a work tool and is pivoted, raised and lowered by the loader arms to operate the work tool.

For certain applications, such as a backhoe attachment, it is desirable to limit pivotal movement of the attachment receiver of the loader as discussed below. Backhoe attachments for skid loaders typically include long articulated arms having a backhoe bucket connected at one end of one of the articulated arms. The present invention provides an improved pivotal movement restraint apparatus for blocking pivotal movement of the attachment receiver of the loader and the mounting frame of the work tool.

In an illustrated embodiment of the invention, a restraint apparatus is provided for limiting pivotal movement of an attachment receiver which is pivotably coupled to movable arms of a loader. The attachment receiver is configured to be coupled to a mounting frame of a work tool. The restraint apparatus comprises an attachment member configured to be coupled to an arm of the loader, a side plate coupled to the attachment member, and a blocking member coupled to the side plate. The blocking member is configured to engage the mounting frame of a work tool to block pivotal movement of the attachment receiver and the mounting frame relative to the loader arms.

In an illustrated embodiment, the blocking member blocks pivotal movement of the attachment receiver while permitting the arms of the loader to be moved up and down between an elevated position and a lowered position. The blocking member illustratively applies a retention force to the mounting frame and the attachment receiver in a direction generally perpendicular to a radius arm of the attachment receiver.

In yet another illustrated embodiment, a restraint assembly is provided for limiting pivotal movement of an attachment receiver which is pivotably coupled to first and second movable arms of a loader. The attachment receiver is configured to be coupled to a mounting frame of a work tool. The restraint assembly comprising a first restraint apparatus coupled to the first arm of the loader, and a second restraint apparatus coupled to the second arm of the loader. The first and second restraint apparatuses each comprise an attachment member configured to be coupled to respective first and second arms of the loader, and a blocking member. Each blocking member is configured to block pivotal movement of the attachment receiver and the mounting frame relative to the first and second loader arms.

In still another illustrated embodiment, a restraint assembly is provided for limiting pivotal movement of an attachment receiver which is pivotably coupled to movable arms of a loader. The attachment receiver is configured to be coupled to a mounting frame of a work tool. The restraint assembly comprises a restraint apparatus configured to engage a portion of the mounting frame of the work tool to block pivotal movement of the attachment receiver and the mounting frame relative to the loader arms, and means for coupling the restraint apparatus to the arms of the loader.

Illustratively, the coupling means secures the restraint apparatus to the arms of the loader without modifying the arms. Also illustratively, the blocking member blocks pivotal movement of the attachment receiver while permitting the arms of the loader to be moved up and down between an elevated position and a lowered position. Preferably, the restraint apparatus applies a retention force to the mounting frame and the attachment receiver in a direction generally perpendicular to a radius arm of the attachment receiver.

BRIEF DESCRIPTION OF THE DRAWINGS

The above-mentioned and other features of this invention, and the manner of attaining them, will become more apparent and the invention itself will be better understood by reference to the following description of illustrated embodiments of the invention taken in conjunction with the accompanying drawings, wherein.

DETAILED DESCRIPTION OF THE DRAWINGS

For the purposes of promoting an understanding of the principles of the invention, reference will now be made to certain illustrated embodiments and specific language will be used to describe the same. It will nevertheless be understood that no limitation of the scope of the invention is thereby intended. Alterations and modifications of the invention, and such further applications of the principles of the invention as described herein as would normally occur to one skilled in the art to which the invention pertains, are contemplated, and desired to be protected.

Figure 1:
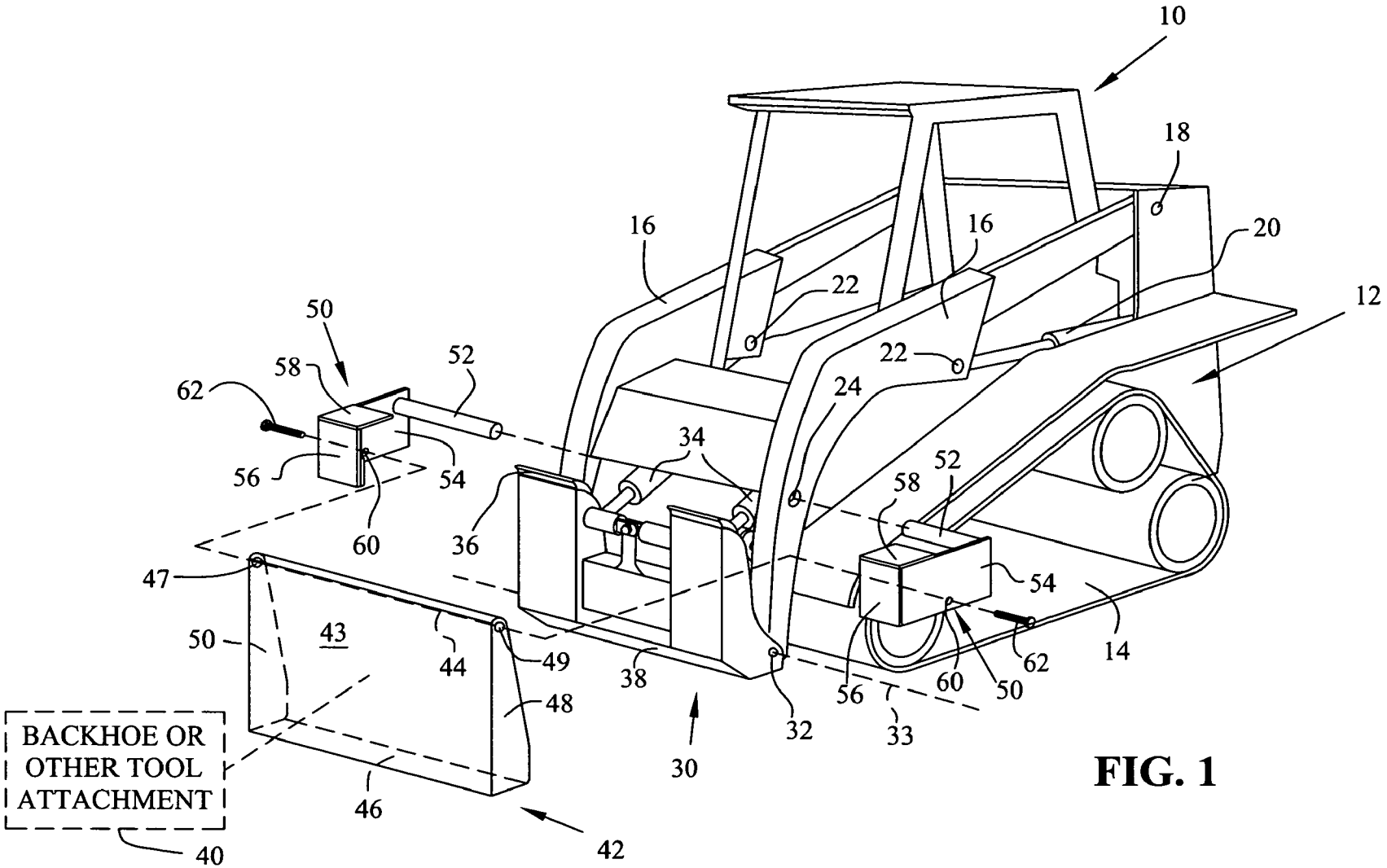
FIG. 1 is an exploded perspective view illustrating a skid steer loader having a front attachment receiver adapted to be coupled to work tool attachments and an mounting frame coupled to a work tool configured to be coupled to the attachment receiver of the loader and further illustrating a restraint apparatus configured to be coupled to the arms of the loader to prevent pivotal movement of the attachment receiver when the work tool is attached.

Referring now to the drawings, FIG. 1 illustrates a skid steer loader 10. As discussed above, loader 10 may illustratively be a Model RC-100 available from ASVI Inc. Loader 10 includes a body portion 12 which propelled along the ground by a drive track 14. It is understood that in other embodiments, wheels may be used in place of drive track 14. Loader 10 includes a pair of arms 16 which are pivotably coupled to the body at locations 18. Hydraulic cylinders 20 on each side of loader 10 are coupled to arms 16 at locations 22. Hydraulic cylinders 20 are actuated to pivot arms 16 upwardly about pivot connections 18 to an elevated position in a conventional manner.

Skid steer loaders 10 were originally developed as a very efficient tool for moving and loading material such as gravel, dirt or animal waste using a bucket attached to the arms 16. Loaders 10 have been made even more versatile through the development of additional accessories or work tools 40 which can be attached to and controlled by the loader 10.

A front attachment receiver 30 is pivotably coupled to the distal end of arms 16 by pivot connections 32. Hydraulic cylinders 34 are actuated to pivot the attachment receiver 30 about pivot connections 32 to rotate a work tool about an axis 33. For maximum flexibility of use, the loader arm attachment receiver 30 has the ability to cause the attached accessory or work tool to pivot as well as to be raised and lowered by the loader arms. The ability of the attachment receiver 30 to tilt improves the efficiency of attachments such as a bucket, auger, forks, and many others.

Figure 4:
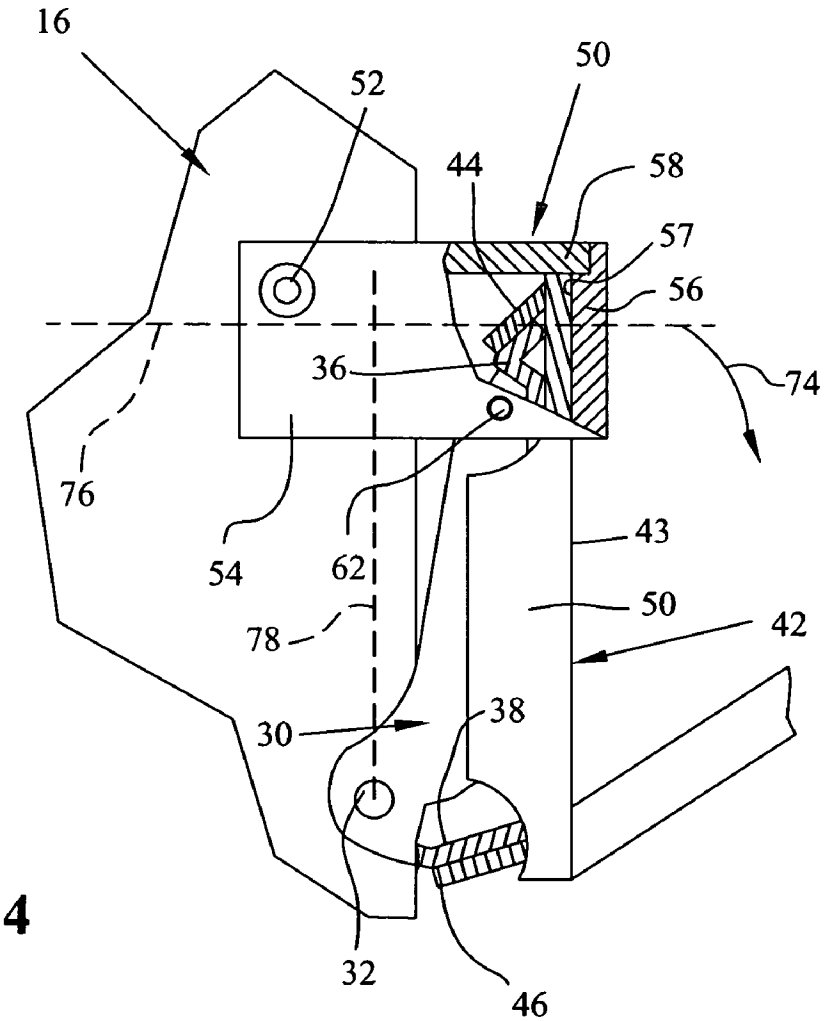
FIG. 4 is a partial sectional view illustrating the attachment receiver of the loader coupled to the mounting frame of the work tool with the restraint apparatus in position to block rotation of the attachment receiver relative to the arms of the loader.

As discussed above, many different work tools 40 may be coupled to the loader 10. Work tools 40 are typically coupled to an mounting frame 42. Mounting frame 42 illustratively includes an upper flange 44, a lower flange 46 and first and second side walls 48 and 50. As best shown in FIG. 4, upper portions 36 of attachment receiver 30 are positioned under the upper flange 44 of mounting frame 42 to couple the tool 40 to the loader 10. A bottom surface 38 of attachment receiver 30 is located on bottom flange 46 of attachment mechanism 42. Therefore, the attachment receiver 30 is easily coupled to and removed from the mounting frame 42 so that the loader 10 can be coupled to various different types of work tools 40.

An accessory that has been proven to add significantly to the versatility of the loader 10 is a backhoe attachment. The backhoe accessory attaches to the loader arm attachment receiver 30 in the same manner as any other accessory. In the case of the backhoe accessory, the force exerted on the hydraulic cylinder 34 used to tilt the attachment receiver 30 is not only a function of the published break out force of the backhoe attachment (typically 6000 pounds), but this force is multiplied by the distance between the attachment receiver pivot point and the reach of the fully extended backhoe divided by the distance between the pivot point 32 of attachment receiver 30 and a top point of the mounting frame 42.

When certain work tools such as the backhoe attachment are attached to the loader, it is desirable for the attachment receiver 30 not to pivot about axis 32. Conventional retention devices have included mechanical structures coupled to the body 12 of loader 10 and to the attachment receiver 30. Such conventional retention devices do not permit the arms 16 to be moved to an elevated position by cylinders 20. In addition, such retention devices typically require modification of the body 12 of the loader 10, such as by drilling holes in the body 12 to secure attachment of retention plates to the front portion of the body 12.

To achieve maximum efficiency in preventing the attachment receiver 30 from pivoting, the mechanical restraint linkage arm should preferably be perpendicular, or close to perpendicular, to a radius arm of the attachment receiver 30 extending from the pivot point 32. In the prior art retention device, an arm coupled from the body 12 to the attachment receiver 30 by a connecting rod aligned at an angle of approximately 45° relative to a radius arm of the attachment receiver 30, thereby allowing some pivotal movement of the attachment receiver 30 about pivot connection 32. Therefore, the hydraulic rams of actuator 34 used to control the pivoting motion are forced to move during us causing hydraulic fluid to forcibly bypass the seals in the hydraulic ram. Accordingly, the prior art retention device allows sufficient rotation of attachment receiver 30 to cause fluid to bypass the seals and subsequently unnecessary wear of the hydraulic ram seals.

In addition, prior art retention device causes insufficient clearance between the bottom of the backhoe attachment receiver 30 and the ground. This clearance is illustratively less than 3". Because the backhoe mechanical restraint linkages are mounted directly to the body frame of the loader in the prior art device, the loader lift arm are locked down and this distance cannot be increased for repositioning of the loader arms 16. For any construction site, a 3" clearance is not satisfactory and causes debris to be collected between the bottom of the backhoe attachment. In some instances, the loader 10 may prematurely bottom out and lose traction because its normal 14" ground clearance has been effectively reduced at the front end to less than 3".

The prior art retention device also requires that plates be mounted on the loader frame for attaching the backhoe mechanical restraint linkages. This requires holes to be drilled into the frame of the loader. Anytime the frame is drilled, cut or welded, the integrity of the frame is compromised.

The restraint apparatus of the present invention provides a mechanical restraint that is substantially perpendicular to a radius arm of the mounting attachment receiver pivot point. The attachment to the loader is non-intrusive (i.e. no drilling, cutting, or welding of the loader frame). The attachment of the mechanical restraint also does not require a person to reach under any part of the backhoe attachment or loader. In addition, the operation of the loader lift arms is not restrained by the restraint apparatus of the present invention. This allows convenient movement of the combined backhoe attachment (or other work tool) and loader by lifting the loader arms and the backhoe attachment to achieve sufficient ground clearance.

The pivot restraint apparatus of the present invention provides an improved device for blocking pivotal movement of the attachment receiver 30 when the work tool 40 is attached via the mounting plate 42. As part of the loader arm 16, the manufacturer of the loader 10 provides a metal tube 24 that connects the two arms 16 together to add structural integrity. This tube 24 provides a place for a non-intrusive connection to the arms 16.

The restraint apparatus 50 of the present invention includes an attachment portion or member 52, illustratively a tube or bar, which is configured to be inserted into the tube 24 that connects the two arms 16 of loader 10. By using the loader arm tube 24, the restraint apparatus 50 of the present invention does not require modifying the loader 10 such as by drilling holes in the arms 16 or body 12 of loader 10 to mount restraint apparatus 50.

It is understood that in another embodiment, the side plates 54 may be coupled to the arms 16 using suitable fasteners such as, for example, bolts, screws, clamps or the like secured to arms 16. Holes may have to be formed in arms 16 for this alternative attachment method. In other words, while a "no holes drilled" attachment method discussed herein is preferred, such attachment method is not required.

Figure 2:
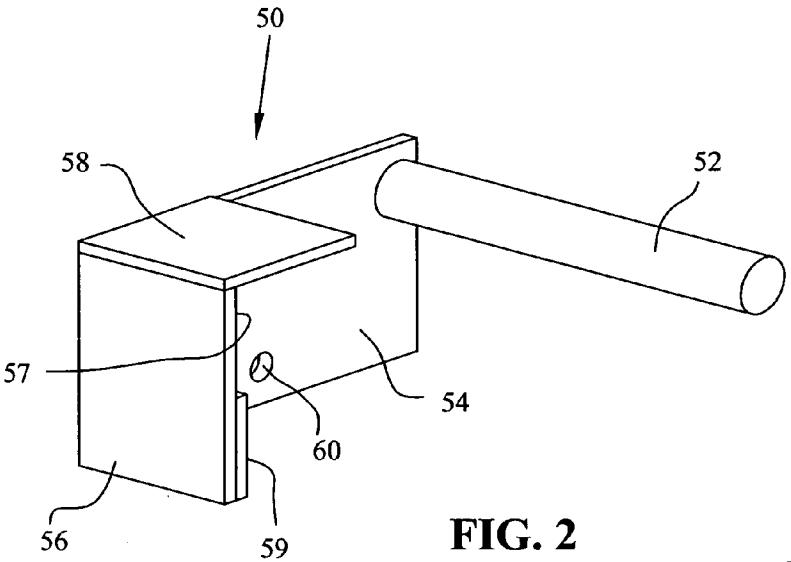
FIG. 2 is a perspective view of one component of the restraint apparatus shown in FIG. 1.
Figure 3:
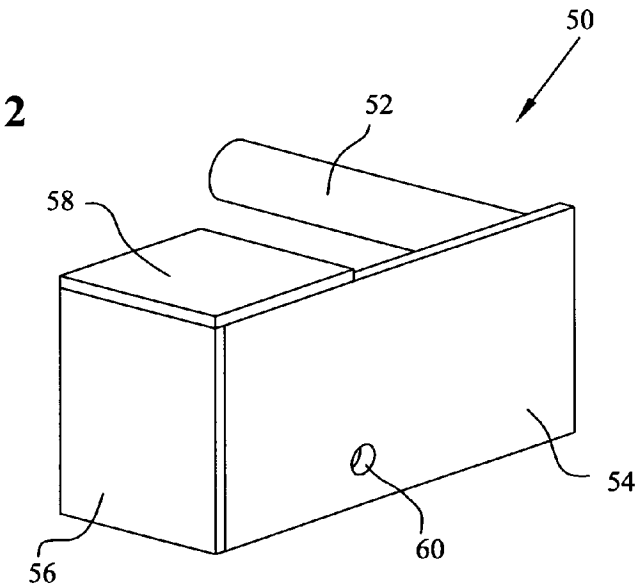
FIG. 3 is a perspective view of another component of the restraint apparatus of FIG. 1.

Restraint apparatus 50 further include a side plate 54 coupled to attachment member 52. An end plate 56 is coupled to one end of side plate 54 opposite from the attachment member 52. A top plate 58 is also coupled to side plate 54 and end plate 56 as best shown in FIGS. 2 and 3. Side plate 54 is formed to include an aperture 60 configured to receive a fastener such as bolt 62 to secure the restraint apparatus 50 to the mounting frame 42 of the work tool 40. The fastener 62 can also be coupled to the attachment receiver 30, if desired. As best shown in FIG. 1, a restraint apparatus 50 is coupled to each arm 16. The first and second restraint apparatuses 50 on opposite sides of the loader are illustratively mirror images of one another.

The attachment member 52 slides into the tube 24 of the loader arm 16. A hook formed by plates 56, 58 then fits over the edge of the backhoe mounting plate 42. The person installing the restraint apparatus 50 is not required to reach under either the backhoe attachment receiver 30 or the loader 10. Because the mechanical restraint 50 is coupled between the loader arm 16 and the attachment receiver 30, the loader arms 16 are not restrained from their normal vertical motion.

In FIG. 1, attachment members 52 are shown as extending only partially across the width of loader 10. In an alternative embodiment, a single attachment member may extend entirely through tube 24 across the width of the loader 10. The attachment member is then coupled to the side plates 54 using pins or other suitable connectors (not shown).

FIG. 4 illustrates the position of the restraint apparatus 50 when the mounting frame 42 is coupled to attachment receiver 30 of loader 10. An inner surface 57 of end plate 56 is located adjacent an outer surface 43 of mounting frame 42. Top plate 58 is located over a top end of the mounting frame 42. A portion 59 having an increased thickness may be provided on inner surface 57 of end plate 56, if desired, to improve retention. When restraint apparatuses 50 are coupled to the arms 16 as shown in FIG. 4, pivotal movement of attachment receiver 30 about pivot coupler 32 in the direction of arrow 74 is blocked or prevented.

In the illustrated embodiment, the restraint apparatuses 50 are coupled to the mounting frame 42 by fasteners 62 to prevent the side plates 54 from pivoting upwardly about attachment members 52. Illustratively, fasteners 62 extend through the apertures 60 in side plates 54 and through apertures 47 or 49, formed in side walls 48, 50, respectively, of the mounting frame 42. In another illustrated embodiment, the fasteners 62 may be coupled to the attachment receiver 30. In yet another embodiment, end plate 56 and mounting frame 42 are each formed with lips configured to engage each other to prevent the side plates 54 from pivoting upwardly about attachment members 52.

FIG. 4 also illustrates that a longitudinal axis 76 of side plate 54 is generally perpendicular to a radius arm 78 of attachment receiver 30 when the attachment receiver 30 is in the general upright position of FIG. 4. This locates the end plate 56 generally parallel to the outer surface 3 of the receiver 30 and to the outer surface 43 of mounting frame 42 to produce the maximum retention force in a direction generally perpendicular to the radius arm 78 to block pivotal movement of the receiver 30 about pivot connection 32.

While the invention has been illustrated and described in detail in the drawings and foregoing description, the description is to be considered as illustrative and not restrictive in character. Variations and modifications exist within the scope and spirit of the present invention as described and defined herein and in the following claims.

The invention claimed is:

1. A restraint apparatus for limiting pivotal movement of an attachment receiver which is pivotably coupled to movable first and second arms of a loader, the attachment receiver being configured to be coupled to a mounting frame of a work tool, the restraint apparatus comprising:

an attachment member configured to be coupled to one of the first and second arms of the loader;

a side plate coupled to the attachment member; and a blocking member coupled to the side plate, the blocking member being configured to engage the mounting frame of the work tool to block pivotal movement of the attachment receiver and the mounting frame relative to the first and second arms.

2. The restraint apparatus of claim 1, wherein the blocking member comprises an end plate coupled to the side plate spaced apart from the attachment member, the end plate having an inner surface located adjacent the mounting frame of the work tool.

3. The restraint apparatus of claim 2, wherein the blocking member further comprises a top plate coupled to the side plate above the end plate, the top plate extending over top portions of the attachment receiver and the mounting frame.

4. The restraint apparatus of claim 1, further comprising a fastener configured to couple the side plate of the restraint apparatus to the mounting frame of a work tool.

5. The restraint apparatus of claim 1, further comprising a fastener configured to couple the side plate of the restraint apparatus to the attachment receiver.

6. The restraint apparatus of claim 1, wherein the attachment member is coupled to one of the first and second arms of the loader by at least one fastener.

7. The restraint apparatus of claim 1, wherein the work tool is a backhoe attachment.

8. The restraint apparatus of claim 1, wherein the blocking member blocks pivotal movement of the attachment receiver while permitting the first and second arms of the loader to be moved up and down between an elevated position and a lowered position.

9. The restraint apparatus of claim 1, wherein the attachment member is an elongated bar configured to extend into a tube connecting the first and second arms of the loader.

10. The restraint apparatus of claim 9, wherein the elongated bar extends only partially across a width of the loader.

11. The restraint apparatus of claim 1, wherein the blocking member applies a force to the mounting frame and the attachment receiver in a direction generally perpendicular to a radius arm of the attachment receiver.

12. A restraint assembly for limiting pivotal movement of an attachment receiver which is pivotably coupled to first and second movable arms of a loader, the attachment receiver being configured to be coupled to a mounting frame of a work tool, the restraint assembly comprising:

a first restraint apparatus coupled to the first arm of the loader; and a second restraint apparatus coupled to the second arm of the loader, the first and second restraint apparatuses each comprising an attachment member configured to be coupled to respective first and second arms of the loader and a blocking member, each blocking member being configured to block pivotal movement of the attachment receiver and the mounting frame relative to the first and second loader arms.

13. The restraint assembly of claim 12, wherein each blocking member comprises a side plate coupled to the attachment member, an end plate coupled to the side plate spaced apart from the attachment member and a top plate coupled to the side plate above the end plate, the end plate having an inner surface located adjacent the mounting frame of the work tool and the top plate extending over top portions of the attachment receiver and the mounting frame.

14. The restraint assembly of claim 12, further comprising first and second fasteners configured to couple the first and second restraint apparatuses, respectively, to one of the mounting frame of a work tool and the attachment receiver.

15. The restraint assembly of claim 12, wherein the attachment member is an elongated portion configured to extend into a tube connecting the arms of the loader.

16. The restraint assembly of claim 15, wherein the elongated portion extends only partially across a width of the loader.

17. A restraint assembly for limiting pivotal movement of an attachment receiver which is pivotably coupled to movable arms of a loader, the attachment receiver being configured to be coupled to a mounting frame of a work tool, the restraint assembly comprising:

a restraint apparatus configured to engage a portion of the mounting frame of the work tool to block pivotal movement of the attachment receiver and the mounting frame relative to the loader arms; and means for coupling the restraint apparatus to the arms of the loader.

18. The restraint assembly of claim 17, wherein the coupling means secures the restraint apparatus to the arms of the loader without modifying the arms.

19. The restraint assembly of claim 17, wherein the blocking member blocks pivotal movement of the attachment receiver while permitting the arms of the loader to be moved up and down between an elevated position and a lowered position.

20. The restraint assembly of claim 17, wherein the restraint apparatus applies a retention force to the mounting frame and the attachment receiver in a direction generally perpendicular to a radius arm of the attachment receiver.

* * * * *